US012037177B2

(12) United States Patent
Guritza

(10) Patent No.: US 12,037,177 B2
(45) Date of Patent: Jul. 16, 2024

(54) EXPANDABLE PADDED MAILER

(71) Applicant: Ranpak Corp., Concord Township, OH (US)

(72) Inventor: Jeffrey J. Guritza, Brecksville, OH (US)

(73) Assignee: Ranpak Corp., Concord Township, OH (US)

( * ) Notice: Subject to any disclaimer, the term of this patent is extended or adjusted under 35 U.S.C. 154(b) by 3 days.

(21) Appl. No.: 18/006,558

(22) PCT Filed: Jul. 22, 2021

(86) PCT No.: PCT/US2021/042688
§ 371 (c)(1),
(2) Date: Jan. 23, 2023

(87) PCT Pub. No.: WO2022/026281
PCT Pub. Date: Feb. 3, 2022

(65) Prior Publication Data

US 2023/0294900 A1 Sep. 21, 2023

Related U.S. Application Data

(60) Provisional application No. 63/056,822, filed on Jul. 27, 2020.

(51) Int. Cl.
*B65D 27/00* (2006.01)
*B65D 81/03* (2006.01)

(52) U.S. Cl.
CPC ..... *B65D 81/03* (2013.01); *B65D 27/005* (2013.01); *B65D 2517/0013* (2013.01); *B65D 2581/053* (2013.01)

(58) Field of Classification Search
CPC ..... B65D 27/16; B65D 27/06; B65D 27/00; B65D 27/14; B65D 27/005; B65D 5/0236;

(Continued)

(56) References Cited

U.S. PATENT DOCUMENTS 5,544,473 A * 8/1996 Maida ..... B65D 81/03 229/928
2007/0046441 A1* 3/2007 McCormick ..... B65D 27/06 340/384.1

(Continued)

FOREIGN PATENT DOCUMENTS

JP 2012020771 A 2/2012
JP 2020083334 A 6/2020

OTHER PUBLICATIONS

International Search Report and Written Opinion mailed Oct. 15, 2021, for priority International Patent Application No. PCT/US2021/042688.

(Continued)

*Primary Examiner* — King M Chu
(74) *Attorney, Agent, or Firm* — Renner, Otto, Boisselle & Sklar, LLP

(57) ABSTRACT

A padded mailer includes a pouch formed by front and rear sheets, each including a bottom edge, a top edge, and opposing side edges. The sheets are connected along their bottom edges and each of their side edges to define an interior space. The top edges of the sheets are unconnected to form an opening into the interior space. The padded mailer also includes a liner disposed in the interior space, including an expandable sheet having a bottom edge, a top edge, and opposing side edges. The bottom edge of the expandable sheet is secured adjacent the bottom edges of the front and rear sheets, and the top edge and the side edges of the expandable sheet are unsecured to the front and rear sheets. Pulling the top edge of the expandable sheet relative to the pouch causes the expandable sheet to expand and increase the thickness of the liner.

20 Claims, 8 Drawing Sheets

(58) Field of Classification Search
CPC ..... B65D 2581/053; B65D 81/03; B31B 2160/10; B31B 70/00
USPC ..... 229/80.5, 305, 80, 117.33; 206/521
See application file for complete search history.

(56) References Cited

U.S. PATENT DOCUMENTS

2012/0248177 A1* 10/2012 Beaulieu ..... B65D 81/03 229/80.5
2017/0107017 A1 4/2017 Kuchar et al.

OTHER PUBLICATIONS

International Preliminary Report on Patentability issued Jan. 31, 2023, for priority International Patent Application No. PCT/US2021/042688.

* cited by examiner

EXPANDABLE PADDED MAILER

This application is a national phase of International Patent Application No. PCT/US2021/042688 filed Jul. 22, 2021, which claims priority to U.S. Provisional Patent Application No. 63/056,822 filed Jul. 27, 2020, each of which is hereby incorporated herein by reference in its entirety.

FIELD OF THE INVENTION

The present invention relates generally to the field of postal packaging, and more particularly to a padded packaging envelope for mailing an article.

BACKGROUND

Padded mailers, such as padded envelopes, are often used to ship items, particularly fragile items. Padded mailers are typically made with plastic air-bubble material lining the inside of the mailer, however, alternatives such as foam, recycled fiber fluff, and paper-based cushioning material may be used. Conventional padded mailers suffer from the limitation of being manufactured and delivered to the user in a ready-to-use state. Specifically, in their ready-to-use state, these padded mailers usually take up the same amount of space during shipment from the manufacturing facility to the point of use as from the user (sender) to the receiver.

SUMMARY

The present disclosure describes a padded mailer that can be manufactured, transported to an end user, and stored in a compact state, and then expanded to an increased-cushioning, higher volume state when ready to use. Accordingly, the padded mailer described here allows for a more efficient and less costly production and shipment of the padded mailer from its manufacturing facility to the point of use.

An exemplary padded mailer includes a pouch formed by front and rear sheets connected at their respective bottom edges and along each of their respective opposing side edges, while remaining unconnected at their respective top edges. The padded mailer includes a liner of at least one expandable sheet, in an unexpanded state, secured to at least one of the front and rear sheets adjacent their respective bottom edges and unconnected at the side and top edges such that the expandable sheet is free to move in a bottom-to-top direction relative to the pouch. When a user receives the padded mailer in the reduced volume, or unexpanded, state, the user can place an article inside the pouch of the padded mailer and pull the expandable sheet in the bottom-to-top direction such that the expandable sheet expands. The expansion of the expandable sheet increases the thickness of the liner, thereby bringing the padded mailer to the increased cushioning, higher volume state. Upon closing and sealing the padded mailer, the expandable sheet remains in the increased-cushioning, higher volume state during shipment from the sender to the receiving to protect the item in transport.

An exemplary padded mailer includes a pouch formed by front and rear sheets. Each sheet includes a bottom edge, a top edge, and opposing side edges. The sheets are connected along their respective bottom edges and along each of their respective opposing side edges to define an interior space. A direction from the bottom edge to the top edge is a bottom-to-top direction. The top edges of the sheets are unconnected to form an opening into the interior space. The padded mailer additionally includes a liner disposed in the interior space. The liner includes at least one expandable sheet that includes a bottom edge, a top edge, and opposing side edges. The bottom edge of the expandable sheet is secured to at least one of the front and rear sheets adjacent their respective bottom edges, and the top edge and the opposing side edges of the expandable sheet are unsecured to the front and rear sheets such that the expandable sheet is free to expand in the bottom-to-top direction relative to the pouch. Pulling the top edge of the expandable sheet in the bottom-to-top direction relative to the pouch causes the expandable sheet to expand and increase the thickness of the liner.

One or more embodiments of the padded mailer may include one or more of the following features, such as that the expandable sheet includes an expandable slit-sheet material. The expandable slit-sheet material has a plurality of rows formed by a plurality of slits. Each of the plurality of rows extends transverse the bottom-to-top direction.

The expandable sheet may have a relatively flat unexpanded state in which the expandable sheet lies flat within a plane, and an expanded state in which the slits are opened to form apertures and portions of the slit-sheet material between the slits are rotated out of the plane.

The padded mailer may include a separator sheet disposed in the interior space. The separator sheet includes a bottom edge, a top edge, and opposing side edges. At least one of the bottom edge and the opposing side edges of the separator sheet is secured to at least one of the front and rear sheets adjacent their respective edges.

The padded mailer may include a pull-tab extending from the top edge of the at least one expandable sheet and extending out from the opening to make it easier for the user to pull the top edge of the expandable sheet in the bottom-to-top direction relative to the pouch to cause expansion.

The pull-tab may include a pull-tab adhesive layer covered by a pull-tab removable release liner.

Any of the front and rear sheets, the expandable sheet, or the separator sheet may be made of paper.

The rear sheet of the pouch may have a greater length in the bottom-to-top direction than the front sheet such that when the bottom edge of the front and rear sheets are aligned, and the top edge of the rear sheet extends beyond the top edge of the front sheet in the bottom-to-top direction to form a pouch flap.

The rear sheet may include a fold line adjacent the top edge of the front sheet to facilitate folding the pouch flap over the top edge of the front sheet to close the opening.

The pouch flap may include a pouch flap adhesive layer adjacent the top edge of the rear sheet on an inner surface of the rear sheet. The inner surface of the rear sheet faces the interior space of the pouch.

The pouch flap adhesive layer may be covered by a pouch flap removable release liner.

The front sheet may include a front sheet adhesive layer adjacent the top edge of the front sheet on an outer surface of the front sheet. The outer surface of the front sheet faces an exterior of the pouch.

The front sheet adhesive layer may be covered by a front sheet removable release liner.

The pouch may include a mechanical fastener adjacent the respective top edges of the front and rear sheets for closing the opening of the pouch.

The pouch may include a gum seal adjacent the respective top edges of the front and rear sheets for closing the opening of the pouch.

The pouch may include at least one gusset where the front sheet is connected to the rear sheet along their respective bottom edges and each of their respective opposing side edges.

An exemplary method of packing an article for shipment includes the step of providing the padded mailer. The method further includes the steps of inserting the article into the interior space of the pouch and pulling the top edge of the expandable sheet to cause the expandable sheet to expand and increase the thickness of the liner. The method then includes the step of securing the top edge of the expandable sheet to the pouch after the pulling step. The method then includes the step of closing the opening of the pouch.

An exemplary method of manufacturing the padded mailer includes the step of providing the front and rear sheets oriented in face-to-face relation. Each sheet includes their respective bottom edges, their respective top edges, and their opposing side edges. The method also includes the step of connecting the front and rear sheets along their respective bottom edges and along each of their respective opposing side edges to define the interior space. The top edges of the sheets remain unconnected to form the opening into the interior space. The method then includes the step of placing the liner in the interior space. The liner includes the at least one expandable sheet including the bottom edge, the top edge, and the opposing side edges of the at least one expandable sheet. The method then includes the step of securing the bottom edge of the expandable sheet to the pouch adjacent the bottom edge of the front and rear sheets. The top edge and the opposing side edges of the expandable sheet are free to move relative to the front and rear sheets of the pouch. Pulling the top edge of the expandable sheet in the bottom-to-top direction relative to the pouch causes the expandable sheet to expand and increase the thickness of the liner.

DETAILED DESCRIPTION

Figure 1:
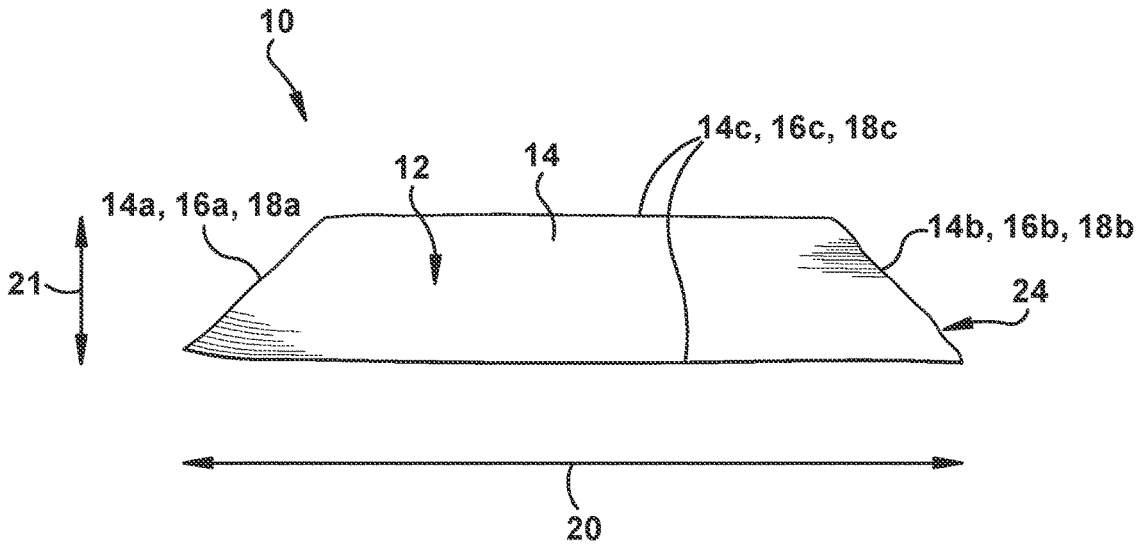
FIG. 1 is a perspective view of an exemplary padded mailer in a reduced volume state.
Figure 2:
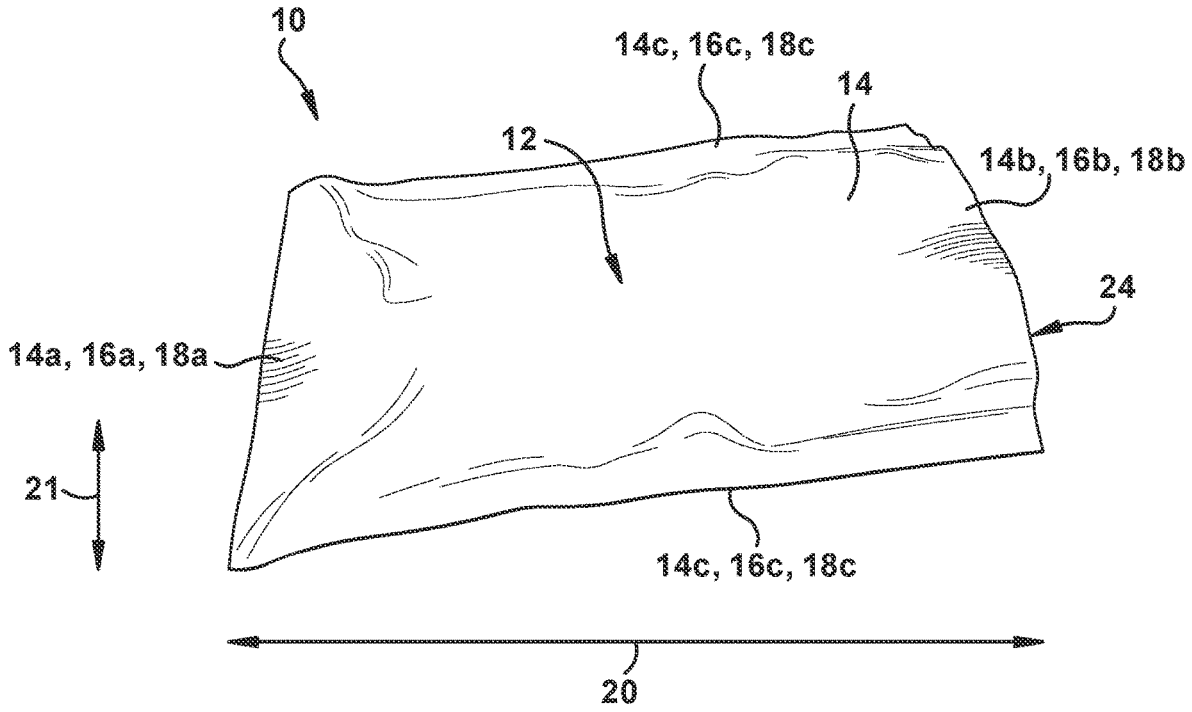
FIG. 2 is a perspective view of the exemplary padded mailer of FIG. 1 in a higher volume state.

Turning now to the drawings, an exemplary padded mailer 10 is configured to be manufactured, transported to an end user, and stored in a reduced volume and compact state, as depicted in FIG. 1. The padded mailer 10 is configured to be expanded to an increased-cushioning, higher volume state, as depicted in FIG. 2, when ready to use. For example, a user may receive the padded mailer 10 in the reduced volume, compact state. When the user is ready to package an article therein for shipment, the user can insert the article into the padded mailer 10 and expand the padded mailer 10 to the increased-cushioning, higher volume state prior to shipping the article packaged therein.

Figure 3:
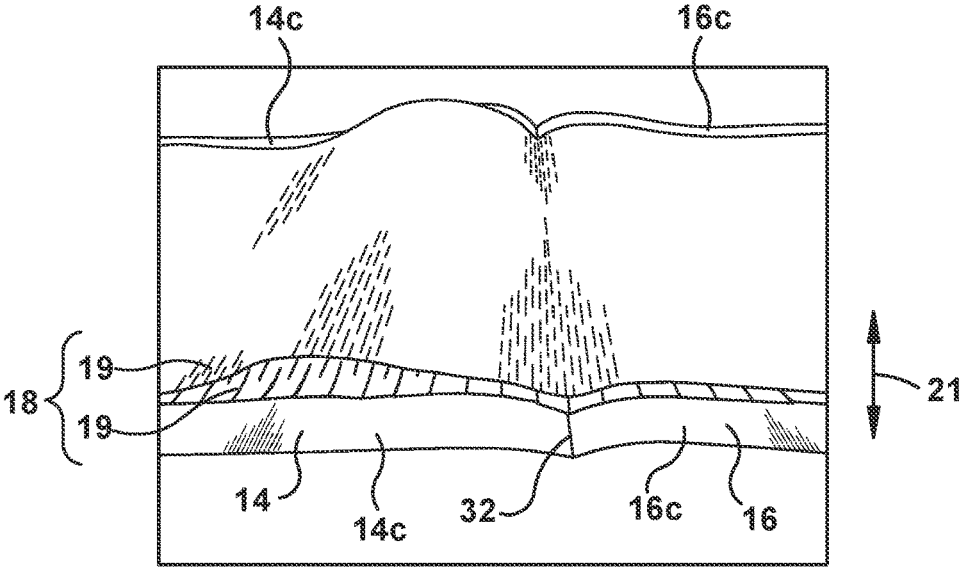
FIG. 3 is a perspective view of the exemplary padded mailer of FIG. 1 in a partially unassembled, open face arrangement.
Figure 4:
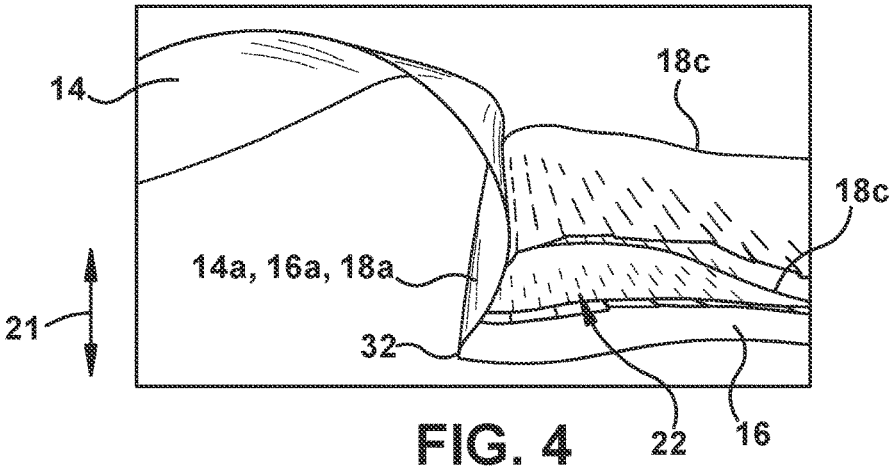
FIG. 4 is a perspective view of the exemplary padded mailer of FIG. 1 in a partially unassembled and partially open face arrangement.
Figure 5:
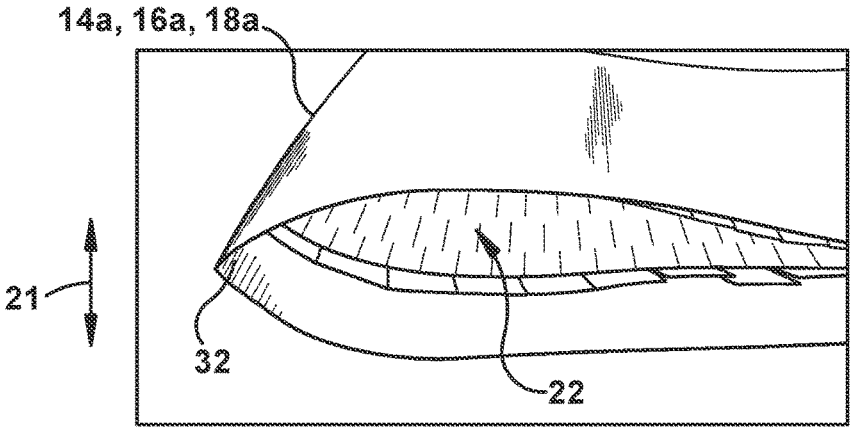
FIG. 5 is a perspective view of the exemplary padded mailer of FIG. 1 in a partially unassembled, closed face arrangement.

With additional reference to FIGS. 3-5, the padded mailer 10 includes a pouch 12 formed by at least a front sheet 14, a rear sheet 16, and a liner 18. FIG. 3 depicts the pouch 12 in a partially unassembled, open face arrangement for purposes of showing the arrangement of the front sheet 14, the rear sheet 16, and the liner 18, relative to each other, in more detail. For the same purpose, FIG. 4 depicts the pouch 12 in a partially unassembled and partially open face arrangement, and FIG. 5 depicts the pouch 12 in a partially unassembled, closed face arrangement.

Each of the front sheet 14, the rear sheet 16, and the liner 18 include a bottom edge 14*a*, 16*a*, 18*a*, respectively, a top edge 14*b*, 16*b*, 18*b*, respectively, and opposing side edges 14*c*, 16*c*, 18*c*, respectively. A direction from the bottom edges 14*a*, 16*a*, 18*a* to the top edges 14*b*, 16*b*, 18*b* is referred to herein as a bottom-to-top direction 20 relative to the pouch 12 and a direction from a face of the front sheet 14 to a face of the rear sheet 16 is referred to herein as a thickness direction 21.

As depicted in FIGS. 1 and 2, the bottom edge 14*a* and the opposing side edges 14*c* of the front sheet 14 are affixed to the bottom edge 16*a* and the opposing side edges 16*c* of the rear sheet 16, respectively, to form an interior space 22 of the assembled pouch 12. The bottom edges 14*a*, 16*a* and opposing side edges 14*c*, 16*c* may be affixed to each other with, for example, an adhesive, a mechanical fastener, or a fold line. The pouch 12 may include at least one gusset where the front sheet 14 is affixed to the rear sheet 16 along their respective bottom edges 14*a*, 16*a* and each of their respective opposing side edges 14*c*, 16*c* for reinforcing the pouch 12. The top edge 14*b* of the front sheet 14 and the top edge 16*b* of the rear sheet 16 remain unconnected from each other to form an opening 24 into the interior space 22 of the pouch 12 for inserting an article to be packaged therein.

The liner 18 is disposed in the interior space 22 and may line a whole or a part of the front sheet 14 and the rear sheet 16 in the interior space 22. The liner 18 includes at least one expandable sheet 19 in an unexpanded state. In the depicted embodiment, the liner 18 includes two expandable sheets 19, each in an unexpanded state. The bottom edge 18*a* of the liner 18 is secured to at least one of the front sheet 14 and the rear sheet 16 adjacent their respective bottom edges 14*a*, 16*a*. The bottom edge 18*a* of the liner 18 may be secured to the front sheet 14 or the rear sheet 16 with, for example, an adhesive, a mechanical fastener, or a fold line. The top edge 18*b* and the opposing side edges 18*c* of the liner 18 are unconnected to the front sheet 14 and the rear sheet 16 such that the liner 18 is free to expand in the bottom-to-top direction 20 relative to the pouch 12. As will be described more fully below, pulling of the top edge 18*b* of the at least one expandable sheet 19 of the liner 18 in the bottom-to-top direction 10 relative to the pouch 12 causes the at least one expandable sheet 19 to expand and increase the thickness of the liner 18 in the thickness direction 21.

The front sheet 14 and rear sheet 16 are made of mailer material such as paper. The mailer material may be any type and grade of paper, depending on the particular application or environment in which the padded mailer 10 is to be used, such as kraft paper. The mailer material may have any of various basis weights and may be made of zero to 100% recycled material. In some embodiments, the mailer material may be laminated or may include any other suitable material such as another paper, plastic sheets, metal foil, or any other combination thereof. Wax or other coatings and chemical treatments may be added to the mailer material to add or improve desired properties such as moisture resistance and thermal resistance for cold chain applications.

In the embodiment depicted in FIGS. 3-5, the pouch 12 is formed by layering the liner 18 over a sheet of mailer material (front sheet 14 and rear sheet 16) and folding the liner 18 and mailer material at a crease 32, the crease 32 thereby forming the bottom edges 14*a*, 16*a*, 18*a* of the front sheet 14, rear sheet 16, and liner 18, respectively. The bottom edge 18*a* of the liner 18 is thereafter secured to at least one of the front sheet 14 and rear sheet 16 adjacent their respective bottom edges 14*a*, 16*a*. Additionally, the respective opposing side edges 14*c*, 16*c* of the front sheet 14 and the rear sheet 16 are thereafter affixed to each other to form the interior space 22.

In another embodiment, however, the front sheet 14 and rear sheet 16 may be provided as independent sheets of mailer material and the respective bottom edges 14*a*, 16*a* and the respective opposing side edges 14*c*, 16*c* thereof may be affixed to each other to form the interior space 22 of the pouch 12. In this embodiment, the liner 18 may be inserted separately and the bottom edge 18*a* thereof secured to at least one of the front sheet 14 and rear sheet 16 adjacent their respective bottom edges 14*a*, 16*a*.

Alternatively, a bottom edge 18*a* of the liner 18 may be secured between the bottom edge 14*a* of the front sheet 14 and the bottom edge 16*a* of the rear sheet 16. Specifically, a method of manufacturing the padded mailer 10 includes the step of providing the front sheet 14 and the rear sheet 16, oriented in face-to-face relation. Each of the front sheet 14 and the rear sheet 16 include their respective bottom edges 14*a*, 16*a*, top edges 14*b*, 16*b*, and opposing side edges 14*c*, 16*c* arranged adjacent respective edges of the other of the front sheet 14 and the rear sheet 16. The method may then include the step of connecting the front sheet 14 and the rear sheet 16 along their respective bottom edges 14*a*, 16*a* and along each of their respective opposing side edges 14*c*, 16*c* to define the interior space 22. The top edges 14*b*, 16*b* remain unconnected to form the opening 24 into the interior space 22. The method then includes the step of placing the liner 18 in the interior space 22. The liner 18 includes at least one expandable sheet 19 including its bottom edge 18*a*, top edge 18*b*, and opposing side edges 18*c*. The method then includes the step of securing the bottom edge 18*a* of the expandable sheet to the pouch 12 adjacent the bottom edges 14*a*, 16*a* of the front sheet 14 and rear sheet 16, respectively. The top edge 18*b* and the opposing side edges 18*c* of the expandable sheet 19 are free to move relative to the front sheet 14 and the rear sheet 16 of the pouch 12. Accordingly, the step of pulling the top edge 18*b* of the expandable sheet 19 in the bottom-to-top direction 20 relative to the pouch 12 causes the expandable sheet 19 to expand and increase the thickness of the liner in the thickness direction 21.

Figure 6A:
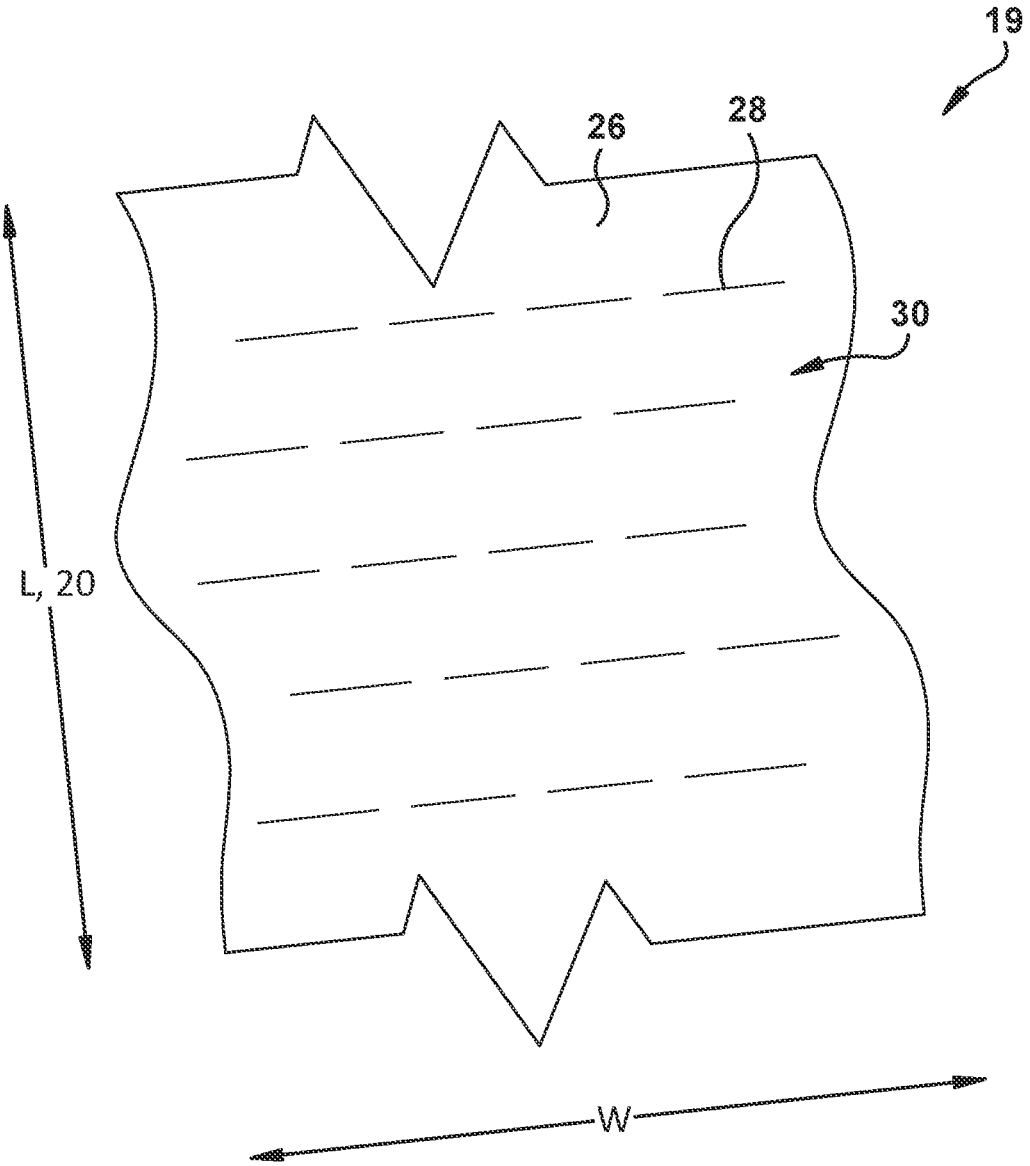
FIGS. 6A and 6B are schematic diagrams of an exemplary slit-sheet material, in an unexpanded state and an expanded state, respectively, used as an expandable sheet in the padded mailer of FIG. 1.
Figure 6B:
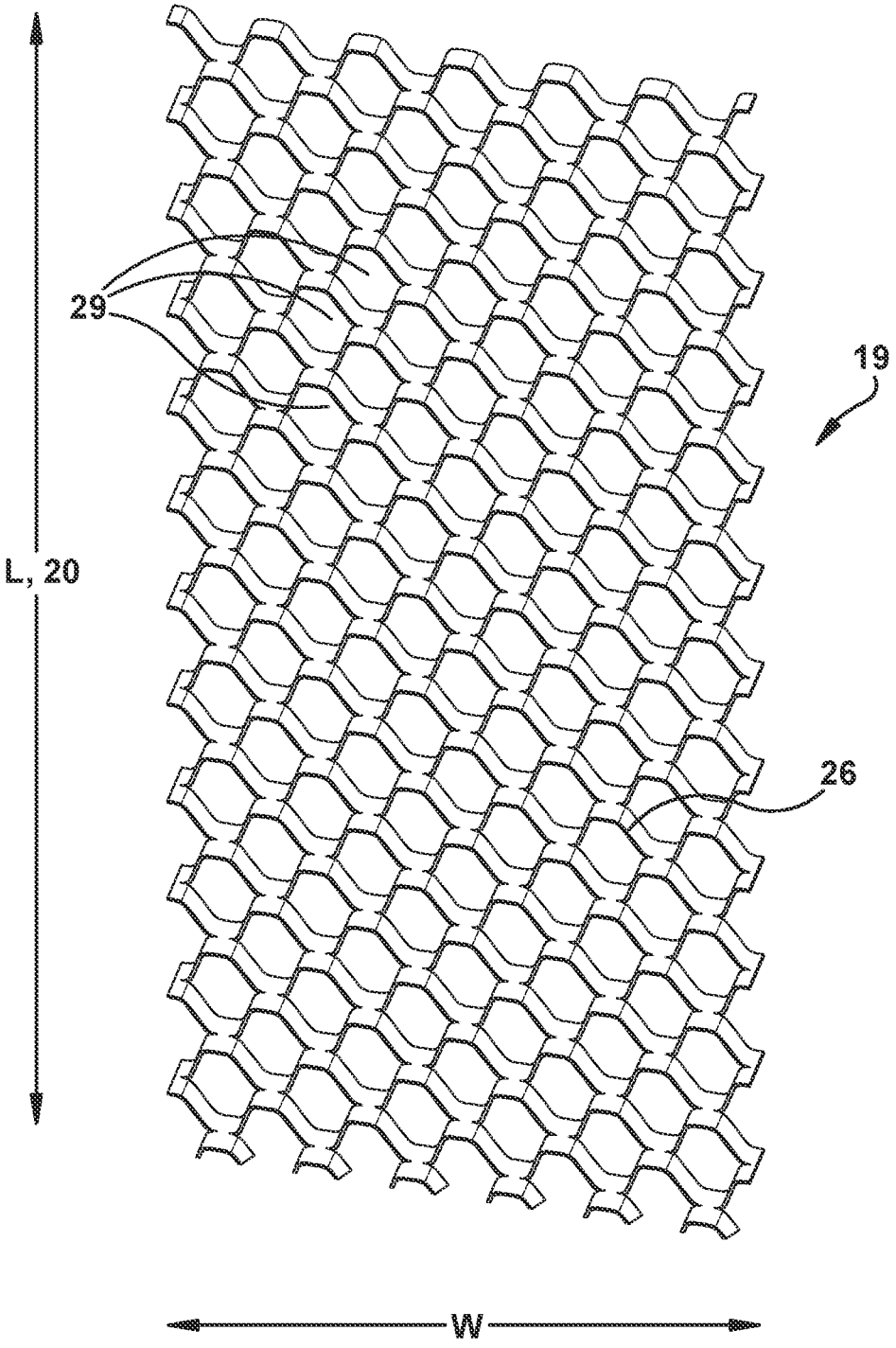

Now turning to FIG. 6A-B, the at least one expandable sheet 19 of the liner 18 is made of slit-sheet material 26. Specifically, FIG. 6A shows the slit-sheet material 26 of the at least one expandable sheet 19 in the unexpanded state and FIG. 6B shows the slit-sheet material 26 in the expanded state. The slit-sheet material 26 has a plurality of slits 28 arranged in a plurality of longitudinally-spaced (i.e., along a length L of the slit-sheet material 26), transversely-extending (i.e., along a width W of the slit-sheet material 26) rows 30 of slits 28. When disposed in the interior space 22 of the pouch 12, the length L of the slit-sheet material 26 extends in the bottom-to-top direction 20 of the pouch 12 and the plurality of rows 30 and slits 28 extend transverse the bottom-to-top direction 20 of the pouch 12.

The slit-sheet material 26 may have any of many alternative arrangements of slits 28 or differing sheet thickness (i.e., a dimension perpendicular to the face of the paper in the perspective shown in FIG. 6). Different arrangements of slits 28 may include any one or more of different arrangements of rows 30 relative to one another, differently-sized slits 28, different spacing between slits 28, different slit shape or slit positioning, such as angular positioning, relative to adjacent slits 28, etc. The slits 28 may be formed by perforating, such as by cutting, or otherwise weakening the slit-sheet material 26 intermittently across the width W of the slit-sheet material 26.

The rows 30 of slits 28 generally are parallel to one another and are generally periodically, and typically equally, longitudinally-spaced from one another. The slits 28 are intermittently but periodically dispersed across the rows 30, with the slits 28 of each row 30 generally being staggered in relation to slits 28 of directly adjacent rows 30. Across each row 30 of slits 28, there may be a greater length of combined slit regions than a combined length of un-slit regions disposed between each slit 28, providing for an optimum amount of expansion of the slit-sheet material 26.

The expandable sheet 19 has a relatively flat unexpanded state in which the expandable sheet 19 lies flat within a plane of the slit-sheet material 26. The slit-sheet material 26 is configured to expand in one or more dimensions to an expanded state in which the slits 18 are opened to form apertures 29 and portions of the slit-sheet material 26 between the slits 28 are rotated out of the plane. For example, when a pulling force is applied to the slit-sheet material 26 in the length direction (i.e., bottom-to-top direction 20 relative to the pouch 12), across the widthwise-extending slits 28, a length of the slit-sheet material 26 increases in the length direction, decreases in width in the widthwise direction, and increases in thickness in a direction transverse both the length direction and the widthwise direction, thereby increasing the volume of the slit-sheet material 26. Specifically, with reference to FIG. 6B, pulling the top edge 18*b* of the liner 18 (the slit-sheet material 26) causes regions of the slit-sheet material 26 on either side of the slits 28 in the longitudinal direction L to be pulled apart from each other and cause the slits 28 to open and form apertures 29 in the slit-sheet material 26. As the slits 28 open, portions of the slit-sheet material 26 between the slits 28 rotate out of the previously linear plane of the slit-sheet material 26. This causes the thickness of the slit-sheet material 26 also to increase, as the rotated regions of the slit-sheet material 26 extend, or protrude, beyond the previous linear plane of the slit-sheet material 26. The thickness of the slit-sheet material 26 in the expanded state may therefore be greater than the thickness of the slit-sheet material 26 in the unexpanded state by an order of magnitude, or more, when stretched in this manner.

As the pulling force is applied to the slit-sheet material 26 in the longitudinal direction and the slit-sheet material 26 is expanded to the expanded state, the slit-sheet material 26 inelastically deforms. This deformation causes the slit-sheet material 26 to remain in an expanded state and decreases the tendency of the slit-sheet material 26 to return to its previous unexpanded state. In other words, the stretching force applied is sufficient to expand the slit-sheet material 26 past its elastic limit. In some embodiments, the deformation may not be completely permanent, which may result in the slit-sheet material 26 having a tendency to recoil and partially return back to a flatter state.

The slit-sheet material 26 may include paper, such as kraft paper, and typically includes single-ply kraft paper. A suitable kraft paper may have various basis weights, such as twenty-pound or forty-pound, for example. The paper itself may be made of zero to 100% recycled material. In some embodiments, the slit-sheet material 26 may be laminated or may include any other suitable material such as another paper, plastic sheets, metal foil, or any other combination thereof. Embossing, perforations, or other features may be added to the slit-sheet material 26 to define predetermined points of deformation, reduce the effort needed to expand the slit-sheet material 26, and reduce the effort needed to maintain an expanded state. Wax or other coatings and chemical treatments may be added to the liner to add or improve desired properties such as moisture and thermal resistance for cold chain applications.

Figure 7:
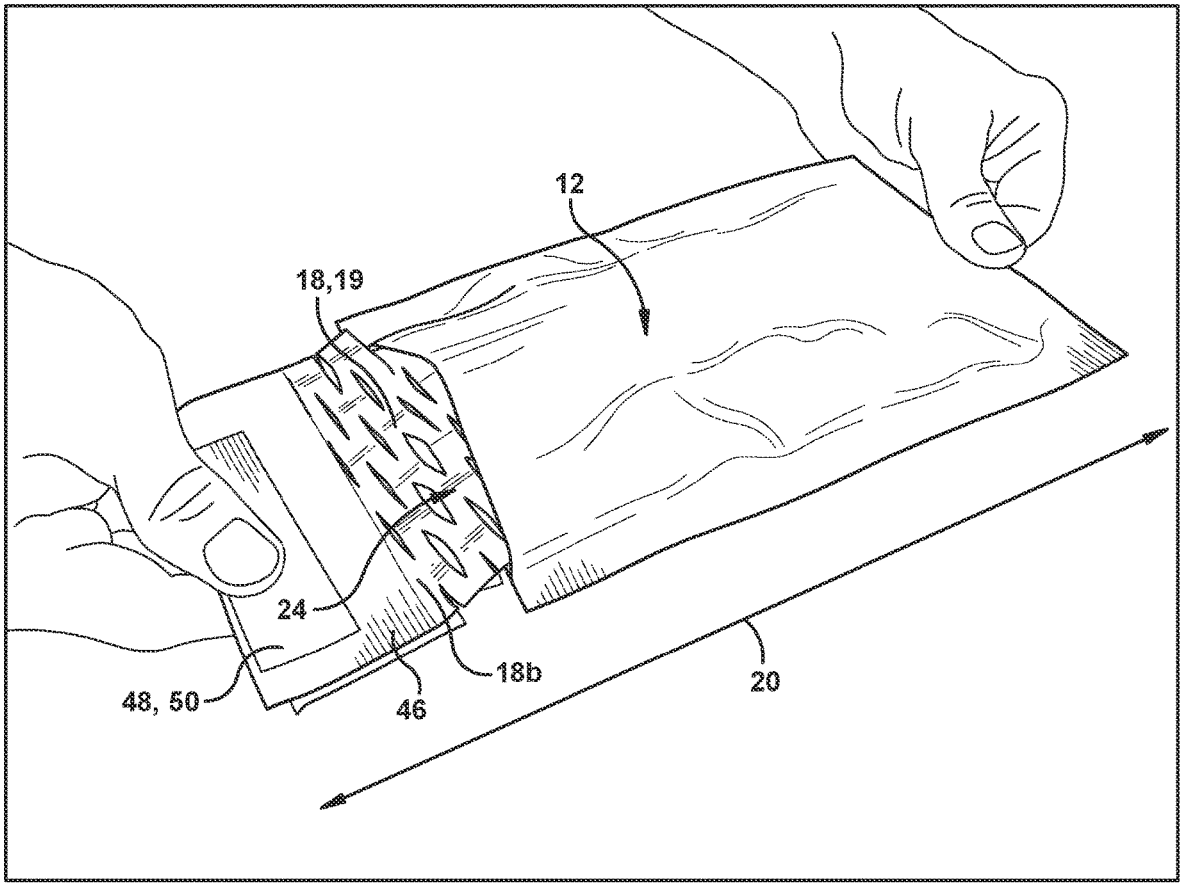
FIG. 7 is a perspective view of an exemplary padded mailer.

With reference to FIG. 7, the padded mailer 10 may include a pull-tab 46 extending from the top edge 18*b* of the liner 18, specifically from the top edge 18*b* of the at least one expandable sheet 19, and extending out from the opening 24 of the pouch 12. The pull-tab 46 is configured to make it easier for the user to pull the top edge 18*b* of the expandable sheet 19 in the bottom-to-top direction 20 relative to the pouch 12 to cause expansion. The pull-tab 46 may include a pull-tab adhesive layer 48 to secure the at least one expandable sheet 19 to at least one of the front sheet 14 and rear sheet 16 after it has been expanded and to prevent the expandable sheet 19 from recoiling and returning to a less expanded state. The pull-tab adhesive layer 48 may be covered by a pull-tab removable release liner 50 to prevent adherence of the pull-tab 46 to anything prior to the pull-tab removable release liner 48 being removed.

The padded mailer 10 may additionally include at least one separator sheet disposed in the interior space 22. The at least one separator sheet also includes a top edge, a bottom edge, and opposing side edges. At least one of the bottom edge and the opposing side edges of the separator sheet may be secured to at least one of the front and rear sheets adjacent their respective edges. For example, the bottom edge and the opposing side edges of the separator sheet may be secured to the front sheet and rear sheet with an adhesive or a mechanical fastener. Alternatively, the separator sheet may be unsecured within the interior space 22.

The separator sheet may be made of paper, such as a lightweight tissue paper. A suitable paper may have various basis weights, such as twenty-pound or forty-pound, for example. The paper itself may be made of zero to 100% recycled material. In some embodiments, the separator sheet may be laminated or may include any other suitable material such as another paper, plastic sheets, metal foil, or any other combination thereof.

Figure 8A:
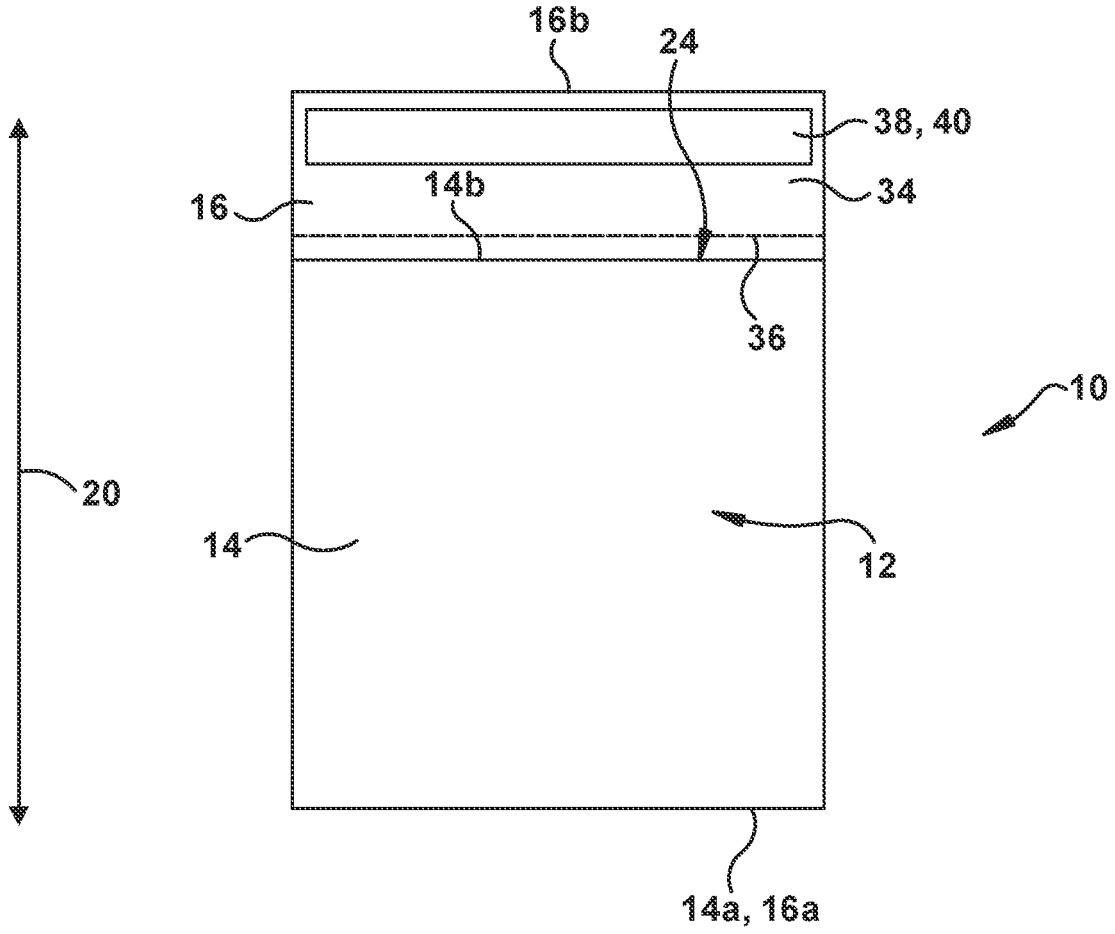
FIGS. 8A and 8B are schematic diagrams of exemplary padded mailers.
Figure 8B:
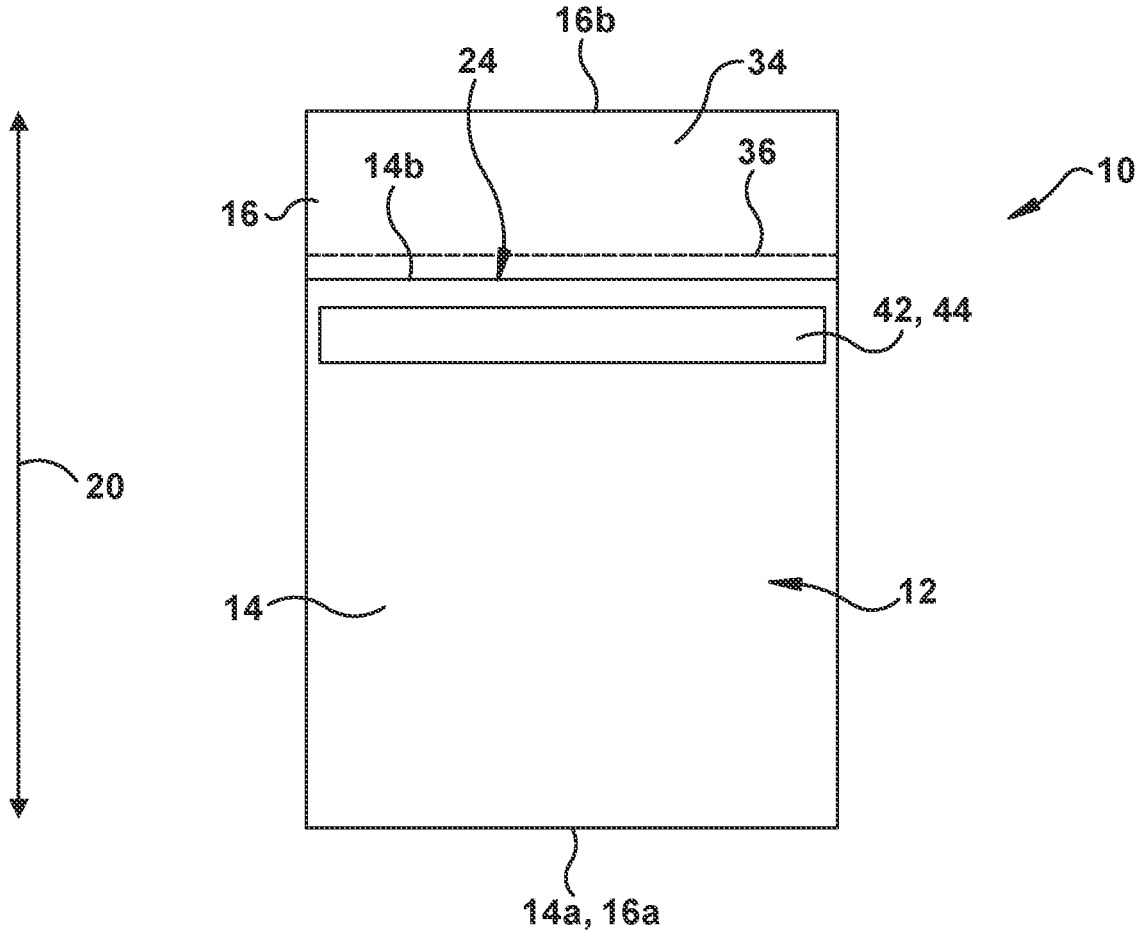

Now turning to FIGS. 8A and 8B, the rear sheet 16 of the pouch 12 may have a greater length in the bottom-to-top direction 20 than the front sheet 14 such that when the bottom edges 14*a*, 16*a* of the front sheet 14 and rear sheet 16 are aligned with each other and affixed, the top edge 16*b* of the rear sheet 16 extends beyond the top edge 14*b* of the front sheet 14 in the bottom-to-top direction 20 to form a pouch flap 34. The pouch flap 34 may be folded over to close the opening 24 of the pouch 12 and may be secured to the front sheet 14 to seal the padded mailer 10 for shipment. The rear sheet 16 may include a fold line 36 adjacent the top edge 14*b* of the front sheet 14, on the pouch flap 34, to facilitate folding of the pouch flap 34 over the top edge 14*b* of the front sheet 14 to close the opening 24 after an article has been inserted therein.

In the embodiment depicted specifically in FIG. 8A, the pouch flap 34 may include a pouch flap adhesive layer 38 adjacent the top edge 16*b* of the rear sheet 16 on an inner surface of the rear sheet 16 (the inner surface of the top sheet 14 facing the interior space 22 of the pouch 12) for sealing the padded mailer 10 for shipment. When the pouch flap 34 is folded over the top edge 14*b* of the front sheet 14, the pouch flap 34 can adhere to the exterior of the front sheet 14, thereby closing the opening 24 and sealing the padded mailer 10. The pouch flap adhesive layer 38 may be covered by a pouch flap removable release liner 40 to prevent adherence of the pouch flap 34 to anything prior to the pouch flap removable release liner 40 being removed, whereupon the pouch flap 34 may be folded over and adhered to the front sheet 14.

In the embodiment depicted specifically in FIG. 8B, the front sheet 14 includes a front sheet adhesive layer 42 adjacent the top edge 14*b* of the front sheet 14 on an outer surface of the front sheet 14 (the outer surface of the front sheet 14 facing an exterior of the pouch 12) for sealing the padded mailer 10 for shipment. Thus, when the pouch flap 34 is folded over the top edge 14*b* of the front sheet 14, the exterior of the front sheet 14 can adhere to the pouch flap 34, thereby closing the opening 24 and sealing the padded mailer 10. The front sheet adhesive layer 42 may be covered by a front sheet removable release liner 44 to prevent adherence of the exterior of the front sheet 14 to anything prior to the front sheet removable release liner 44 being removed.

In addition to or in place of the pouch flap adhesive layer 38 and the front sheet adhesive layer 42, the pouch 12 may include a mechanical fastener adjacent the respective top edges 14*b*, 16*b* of the front sheet 14 and the rear sheet 16, for example on the pouch flap 34, for closing the opening of the pouch. The pouch 12 may also or alternatively include a gum seal adjacent the respective top edges 14*b*, 16*b* of the front sheet 14 and the rear sheet 16, for example, on the pouch flap 34, for closing the opening of the pouch 12.

Figure 9A:
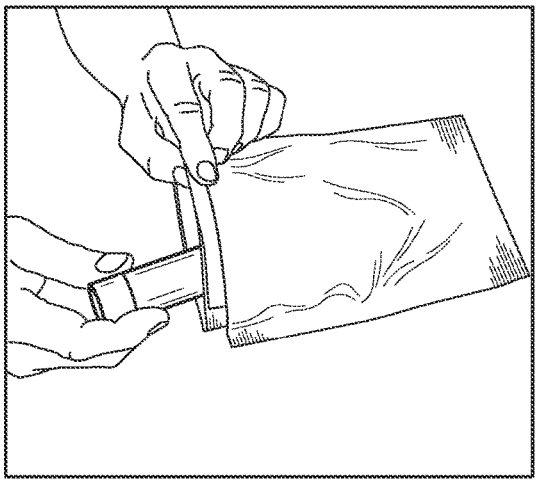
FIGS. 9A-D are sequential perspective views of the exemplary padded mailer of FIG. 1 illustrating steps a user might take in packing an article therein.
Figure 9B:
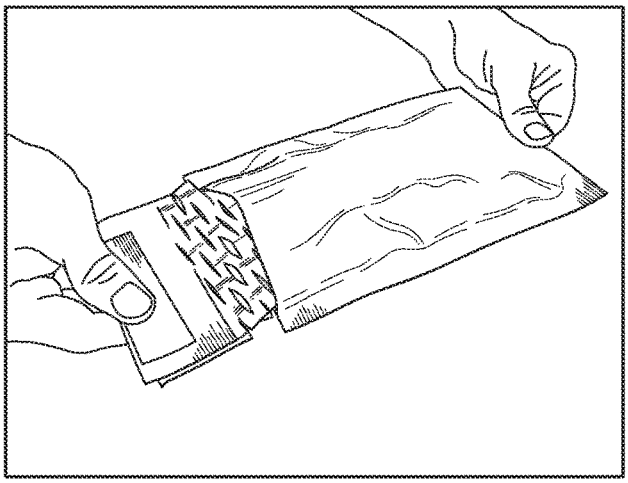
Figure 9C:
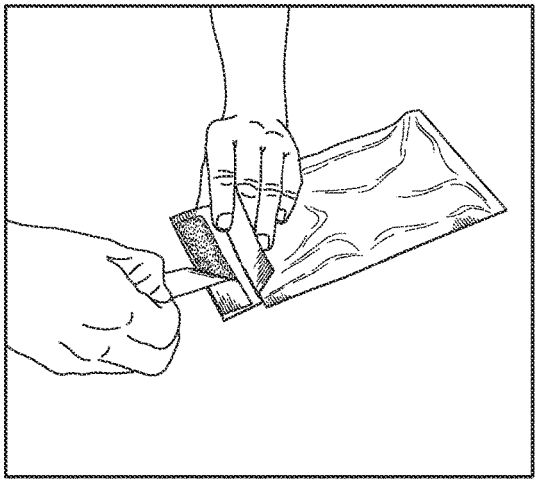
Figure 9D:
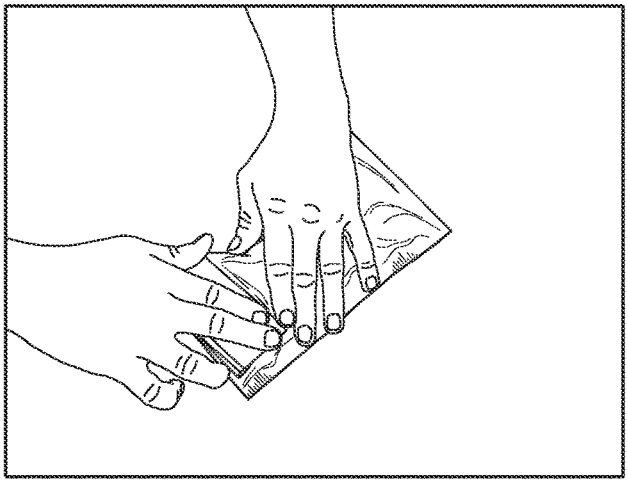

Turning now to FIGS. 9A-9D, a method of packing an article for shipment using the padded mailer 10 is depicted in sequential steps. Specifically, as depicted in FIG. 9A, the method includes the steps of providing the padded mailer 10 described above and inserting an item into the interior space 22 of the pouch 12. As depicted in FIG. 9B, the method further includes pulling the top edge 18*b* of the liner 18, particularly the at least one expandable sheet 19, to cause the at least one expandable sheet 19 to expand and increase the thickness of the liner 18 in the thickness direction 21. The pulling step may be facilitated by the presence of the pull-tab 46, described above. As depicted in FIG. 9C, the method then includes the step of securing the top edge 18*b* of the liner 18 to the pouch 12 after the pulling step. The securing step may be accomplished with the use of the pull-tab adhesive layer 48. Accordingly, the method may additionally include the step of removing a pull-tab removable release liner 50 prior to securing the top edge 18*b* of the liner 18 to the pouch 12. Finally, as depicted in FIG. 9D, the method may include the step of closing the opening 24 of the pouch 12 by, for example, use of the pouch flap 34 described above.

In summary, the described padded mailer 10 includes a pouch 12 formed by front and rear sheets 14, 16, each including a bottom edge 14*a*, 16*a*, a top edge 14*b*, 16*b*, and opposing side edges 14*c*, 16*c*. The sheets 14, 16 are connected along their bottom edges 14*a*, 16*a* and each of their side edges 14*c*, 16*c* to define an interior space 22. The top edges 14*b*, 16*b* of the sheets are unconnected to form an opening 24 into the interior space 22. The padded mailer 10 also includes a liner 18 disposed in the interior space 22, including an expandable sheet 19 having a bottom edge 18*a*, a top edge 18*b*, and opposing side edges 18*c*. The bottom edge 18*a* of the expandable sheet 19 is secured adjacent the bottom edges 14*a*, 16*a* of the front and rear sheets 14, 16, and the top edge 18*b* and the side edges 18*c* of the expandable sheet 19 are unsecured to the front and rear sheets 14, 16. Pulling the top edge 18*b* of the expandable sheet 19 relative to the pouch 12 causes the expandable sheet 19 to expand and increase the thickness of the liner 18.

Although one embodiment is shown and described, equivalent alternations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the illustrated exemplary embodiment.

I claim:

1. A padded mailer, comprising:

a pouch formed by front and rear sheets, wherein each sheet includes a bottom edge, a top edge, and opposing side edges, wherein the sheets are connected along their respective bottom edges and along each of their respective opposing side edges to define an interior space, wherein a direction from the bottom edges to the top edges is a bottom-to-top direction, and wherein the top edges of the sheets are unconnected to form an opening into the interior space; and a liner disposed in the interior space, the liner including at least one expandable sheet that includes a bottom edge, a top edge, and opposing side edges, wherein the bottom edge of the expandable sheet is secured to at least one of the front and rear sheets adjacent their respective bottom edges, and the top edge and the opposing side edges of the expandable sheet are unsecured to the front and rear sheets such that the expandable sheet is free to expand in the bottom-to-top direction relative to the pouch;

wherein pulling the top edge of the expandable sheet in the bottom-to-top direction relative to the pouch causes the expandable sheet to expand and increase the thickness of the liner.

2. The padded mailer of claim 1, wherein the expandable sheet includes an expandable slit-sheet material having a plurality of rows formed by a plurality of slits, wherein each of the plurality of rows extends transverse the bottom-to-top direction; wherein the plurality of slits that form the rows extend transverse the bottom-to-top direction.

3. The padded mailer of claim 2, wherein the expandable sheet has a relatively flat unexpanded state in which the expandable sheet lies flat within a plane, and an expanded state in which the slits are opened to form apertures and portions of the slit-sheet material between the slits are rotated out of the plane.

4. The padded mailer of claim 1, further comprising a separator sheet disposed in the interior space, the separator sheet including a top edge, a bottom edge, and opposing side edges, wherein at least one of the bottom edge and the opposing side edges of the separator sheet is secured to at least one of the front and rear sheets adjacent their respective edges.

5. The padded mailer of claim 1, further comprising a pull-tab extending from the top edge of the at least one expandable sheet and extending out from the opening to make it easier for the user to pull the top edge of the expandable sheet in the bottom-to-top direction relative to the pouch to cause expansion.

6. The padded mailer of claim 5, wherein the pull-tab includes a pull-tab adhesive layer covered by a pull-tab removable release liner.

7. The padded mailer of claim 1, wherein the front and rear sheets are made of paper.

8. The padded mailer of claim 1, wherein the expandable sheet is made of paper.

9. The padded mailer of claim 4, wherein the separator sheet is made of paper.

10. The padded mailer of claim 1, wherein the rear sheet of the pouch has a greater length in the bottom-to-top direction than the front sheet such that when the bottom edges of the front and rear sheets are aligned, the top edge of the rear sheet extends beyond the top edge of the front sheet in the bottom-to-top direction to form a pouch flap.

11. The padded mailer of claim 10, wherein the rear sheet includes a fold line adjacent the top edge of the front sheet to facilitate folding the pouch flap over the top edge of the front sheet to close the opening.

12. The padded mailer of claim 10, wherein the pouch flap includes a pouch flap adhesive layer adjacent the top edge of the rear sheet on an inner surface of the rear sheet, the inner surface of the rear sheet facing the interior space of the pouch.

13. The padded mailer of claim 12, wherein the pouch flap adhesive layer is covered by a pouch flap removable release liner.

14. The padded mailer of claim 1, wherein the front sheet includes a front sheet adhesive layer adjacent the top edge of the front sheet on an outer surface of the front sheet, the outer surface of the front sheet facing an exterior of the pouch.

15. The padded mailer of claim 14, wherein the front sheet adhesive layer is covered by a front sheet removable release liner.

16. The padded mailer of claim 1, wherein the pouch includes a mechanical fastener adjacent the respective top edges of the front and rear sheets for closing the opening of the pouch.

17. The padded mailer of claim 1, wherein the pouch includes a gum seal adjacent the respective top edges of the front and rear sheets for closing the opening of the pouch.

18. The padded mailer of claim 1, wherein the pouch includes at least one gusset where the front sheet is connected to the rear sheet along their respective bottom edges and each of their respective opposing side edges.

19. A method of packing an article for shipment using the padded mailer of claim 1, comprising the steps of:

providing the padded mailer;

inserting the article into the interior space of the pouch;

pulling the top edge of the expandable sheet to cause the expandable sheet to expand and increase the thickness of the liner;

securing the top edge of the expandable sheet to the pouch after the pulling step; and closing the opening of the pouch.

20. A method of manufacturing the padded mailer of claim 1, the method comprising the steps of:

providing the front and rear sheets oriented in face-to-face relation, each sheet including their respective bottom edge, their respective top edge, and their opposing side edges;

connecting the front and rear sheets along their respective bottom edges and along each of their respective opposing side edges to define the interior space, wherein the top edges of the sheets remain unconnected to form the opening into the interior space;

placing the liner in the interior space, the liner including the at least one expandable sheet including the bottom edge, the top edge, and the opposing side edges of the at least one expandable sheet;

securing the bottom edge of the expandable sheet to the pouch adjacent the bottom edges of the front and rear sheets, wherein the top edge and the opposing side edges of the expandable sheet are free to move relative to the front and rear sheets of the pouch;

wherein pulling the top edge of the expandable sheet in the bottom-to-top direction relative to the pouch causes the expandable sheet to expand and increase the thickness of the liner.

* * * * *